US005411635A

United States Patent [19]

Francis et al.

[11] Patent Number: 5,411,635

[45] Date of Patent: May 2, 1995

[54] OZONE/PEROXYMONOSULFATE PROCESS FOR DELIGNIFYING A LIGNOCELLULOSIC MATERIAL

[75] Inventors: Raymond C. Francis, Dewitt; Xioa-Zhu Zhang, Syracuse, both of N.Y.; Nicholas A. Troughton, Brussels, Belgium

[73] Assignees: The Research Foundation of State University of New York, Albany, N.Y.; Solvay Interox, Brussels, Belgium

[21] Appl. No.: 34,092

[22] Filed: Mar. 22, 1993

[51] Int. Cl.[6] ..... D21C 9/153; D21C 9/16

[52] U.S. Cl. ..... 162/65; 162/76; 162/78; 162/89

[58] Field of Search ..... 162/76, 65, 89, 78

[56] References Cited

U.S. PATENT DOCUMENTS

| | | | |
|---|---|---|---|
| 4,404,061 | 9/1983 | Cael | 162/76 |
| 4,450,044 | 5/1984 | Fritzvold et al. | 162/65 |
| 4,475,984 | 10/1984 | Cael | 162/76 |
| 4,568,420 | 2/1986 | Nonni | 162/65 |
| 4,773,966 | 9/1988 | Huynh | 162/78 |
| 4,902,381 | 2/1990 | Meredith | 162/65 |
| 5,004,523 | 4/1991 | Springer et al. | 162/76 |
| 5,034,096 | 7/1991 | Hammer et al. | 162/65 |
| 5,074,960 | 12/1991 | Nimz et al. | 162/65 |
| 5,164,044 | 11/1992 | Griggs et al. | 162/57 |

FOREIGN PATENT DOCUMENTS

0415149A2 1/1990 European Pat. Off. .

OTHER PUBLICATIONS

Patt et al. "Einsatz von Ozon zur Zellstoffbleiche" *Das papier* 42, V14–V23 (1988).

Hammann et al. "Bleachability and chlorine free bleaching—Bleaching of sulfite pupls—Mill experiences" *International Pulp Beaching Conference, Production of Beached Chemical Pulp in the Future,* Stockholm, Sweden 3 185–200 (1991).

*Primary Examiner*—Steve Alvo

*Attorney, Agent, or Firm*—Heslin & Rothenberg

[57] ABSTRACT

A process for delignifying a lignocellulosic material comprising exposing the material to a mixture of peracid and ozone. Preferred peracids include Caro's acid and peracetic acid. Also disclosed is a kraft pulp delignification mixture comprising in combination: (a) water; (b) a kraft pulp at 1–40% consistency; (c) a peracid; and (d) from 0.1 to 5.0% ozone on pulp.

15 Claims, 6 Drawing Sheets

OZONE/PEROXYMONOSULFATE PROCESS FOR DELIGNIFYING A LIGNOCELLULOSIC MATERIAL

BACKGROUND OF THE INVENTION

1. Field of the Invention

The invention relations to the field of paper manufacturing and, more particularly, to a process and composition for delignifying a lignocellulosic material, such as chemical wood pulp, using a mixture of ozone and a peracid, particularly peroxymonosulfate.

2. Information Disclosure

Pulp is the raw material for the production of paper, paperboard, fiberboard and the like. In purified form, it is a source of cellulose for rayon, cellulose esters and other cellulosic products. Pulp is obtained from plant fiber such as wood, straw, bamboo and sugarcane residues. Wood is the source of 95% of the pulp fiber produced in the United States.

Dry wood consists of 40 to 50 percent cellulose, 15 to 25 percent other polysaccharides known as hemicelluloses, 20–30 percent lignin, a biopolymer which acts as a matrix for the cellulose fibers, and 5 percent of other substances such as mineral salts, sugars, fat, resin and protein. Lignin is composed primarily of methoxylated phenyl propane monomeric units interconnected by a variety of stable carbon-carbon and carbon-oxygen (ether) linkages. The lignin of conifers is apparently an oxidative polymerization product of coniferyl alcohol [3-(3'-methoxy-4'-hydroxyphenyl)allyl alcohol], while the lignin of deciduous trees appears to be derived from coniferyl alcohol and sinapyl alcohol [3(3',5'dimethoxy-4'-hydroxphenyl)allyl alcohol].

The strength of paper ultimately produced from pulp is dependent upon the chemical integrity of the cellulose, while the color arises from the lignin. The desired selectivity of a delignification process will be reflected in a low kappa number (little residual lignin) and a high viscosity of the residual pulp (little cleavage of long-chain celluloses).

Chemical pulp is manufactured by dissolving the lignin with hot solutions of (1) sodium hydroxide, (2) calcium, magnesium, or ammonium bisulfite, or (3) a mixture of sodium hydroxide and sodium sulfide (made from lime and reduced sodium sulfate). The products, known as soda pulp, sulfite pulp or sulfate (kraft) pulp, respectively consist of impure cellulose. In the chemical process, most of the hemicelluloses are also dissolved. Thus, the yield for chemical pulping is typically 40–60% based on wood weight. Mechanical pulps are characterized by their high yield and high lignin content. These pulps are called "mechanical" because a significant amount of mechanical energy (grinding and refining) is required to breakdown the wood chips. Chemical pulps contain about 5% lignin (weight basis) while mechanical pulps typically contain greater than 15% lignin. In order to make a white sheet from a chemical pulp almost all of the residual lignin must be removed. This is normally achieved by multistage bleaching using oxidants, some of which [chlorine ($Cl_2$), chlorine dioxide ($ClO_2$), and sodium hypochlorite (NaOCl)] contain chlorine. Presently, producers of bleached chemical pulp are seeking ways of decreasing or eliminating the use of chlorine-containing chemicals, the use of which leads to the formation and subsequent discharge of organochlorine compounds. Regulations to limit the discharge of adsorbable organic halogens (AOX) have already been established in several countries.

Replacement chemicals presently being used commercially or in research include oxygen, ozone, hydrogen peroxide and other peroxides. Oxygen is less selective than chlorine and chlorine dioxide and can therefore only be used for partial lignin removal. The cellulose is strongly affected, especially when the lignin content is low; therefore, the oxygen treatment must be of short duration.

Peroxymonosulfuric acid or Caro's acid and its caroate anions have features that are attractive for kraft pulp bleaching: 1) Caro's acid is a more efficient solubilizer of lignin than is $H_2O_2$, 2) it is only marginally more expensive than $H_2O_2$ because $H_2SO_4$ is the only reactant needed to generate it from $H_2O_2$, and 3) the sulfate anions in the resulting bleaching effluent can be recycled to the kraft recovery system. The use of Caro's acid for bleaching pulp is disclosed in U.S. Pat. Nos. 4,404,061; 4,475,984; 4,756,800; 4,773,966; 5,004,523 and European Patent 415 149. The formation reactions for Caro's acid and caroate anions are summarized in the following equations:

$$X\ H_2SO_4 + H_2O_2 \rightleftharpoons H_2SO_5 + (X-1)\ H_2SO_4 + H_2O \qquad [1.]$$

$$H_2SO_5 + H_2O + \rightleftharpoons HSO_5^- + H_3O^+ pKa < O \qquad [2.]$$

$$HSO5^- + H_2O \rightleftharpoons SO_5^= + H_3O^+ pKa = 9.4 \qquad [3.]$$

The drawback of caroate delignification is the requirement of approximately 2.0 moles $H_2SO_4$ per mole of $H_2O_2$ to obtain a high yield of $H_2SO_5$ in accordance with equation [1]. Using such a mole ratio, 17 kg of $Na_2SO_4$ would be produced in a non-acidic effluent by the application of 2 kg of $H_2O_2$ converted to Caro's acid or caroate. The kraft recovery system operates under alkaline conditions and requires approximately 17 kg $Na_2SO_4$/ton of pulp as make-up chemical. If a chemical balance is to be maintained without process modification, then the caroate charge would be limited to 2 kg equiv. $H_2O_2$/ton or 0.94 kg active oxygen (one active oxygen atom per hydrogen peroxide or caroate molecule). Fortunately, $Na_2SO_4$ can be precipitated from the kraft recovery system. Still, even if process changes are made, the caroate charge is likely to be limited to approximately 0.25% active oxygen (A.O.) on pulp (1.77% $HSO_5^-$). To design a reaction tower and washing system for such a low oxidant charge is not economically attractive. Moreover the delignification that is possible with an upper limit of 0.25% active oxygen from caroate is not adequate for many purposes.

Ozone delignification is well known in the art (see U.S. Pat. No. 5,164,044 and references therein). Its major drawback is that both ozone itself and hydroxyl radicals generated from the ozone attack cellulose along with lignin. Hydroxyl radicals are relatively unselective toward lignin in the presence of cellulose. The result is that it is recommended that the ozone charge be limited to 1% of the pulp weight to avoid significant loss in strength of paper made from ozone-delignified pulp. [see Patt et al. *Das Papier* 42, V14–V23 (1988)].

There is thus a need for a delignification process that is highly selective for lignin with minimal concomitant degradation of cellulose polymers.

There is a further need for a process for bleaching chemical wood pulp that minimizes or avoids the use of chlorine-based bleaching agents while at the same time not creating waste disposal problems of its own.

SUMMARY OF THE INVENTION

It is an object of the present invention to provide a process for bleaching chemical wood pulp that avoids the use of chlorine-containing bleaching agents.

It is a further object to provide a process that is selective for lignin and minimizes degradation of cellulose.

It is a further object to provide a process for bleaching chemical pulp that minimizes waste-disposal problems.

It is a further object to provide a process and composition that are economically attractive compared to existing systems.

These and other objects, features and advantages are provided by the present invention.

In one aspect the invention relates to a process for delignifying a lignocellulosic material, in particular for bleaching wood pulp, most particularly for kraft wood pulp. In its most generic form, it comprises treating the pulp with a mixture of ozone and a peracid or a combination of peracids. The pH of the mixture is maintained between pH 1 and a pH which is about one pH unit lower than the pKa of the peracid or the lowest pKa of the combination of peracids. In one, narrower aspect the process comprises treating the wood pulp at a temperature of 10° C. to 80° C. and pH 2.5 to 8.4 with a mixture of peroxymonosulfate and ozone. Preferably the peroxymonosulfate is applied at from 0.1 to 2.0% active oxygen based on the dry weight of the lignocellulosic material, most preferably at from 0.1 to 0.5% active oxygen. Preferably the ozone is provided at from 0.1 to 5.0% based on the dry weight of the lignocellulosic material, most preferably at 0.5 to 3.0%. The lignocellulosic material may be at a consistency of from 1% to 40% in water; preferably the consistency is from 8 to 35%, the pH is from 3.0 to 6.0, and the temperature is 20° C. to 50° C.

In another aspect, the invention relates to a kraft pulp delignified according to the process described above.

In a further aspect, the invention relates to a kraft pulp delignification mixture comprising:

(a) water at pH 2.5 to 8.4 and 10° C. to 80° C.;
(b) a kraft pulp in an amount equal to from 1 to 40% by weight of the total of water plus kraft pulp (i.e., consistency);
(c) a peroxymonosulfate at 0.0008 to 0.5M; and
(d) ozone at 0.1 to 5% of the dry weight of the kraft pulp.

Preferably the water is at pH 3.0 to 6.0 and from 20° C. to 50° C.; the kraft pulp is from 8 to 35% by weight of the total; the persulfate is 0.002 to 0.4M; and the ozone is at 0.5 to 3.0% based on the dry weight of the kraft pulp.

In another aspect the invention relates to a process for delignifying a lignocellulosic material by treating the material at a temperature of 10° to 80° C. with a mixture of ozone and a monoperacid. The monoperacid has a pKa of about 6.0 to about 10.0, and the mixture has a pH from about 2.5 to about 1 pH unit lower than the pKa of the peracid. A preferred monoperacid is peracetic acid which is used at pH 3.0 to 7.2. The process may include additional steps of alkaline extraction and oxidative bleaching. The alkaline extraction may be enhanced by the addition of an oxidant selected from the group consisting of oxygen, hydrogen peroxide, hypochlorite, oxygen plus hydrogen peroxide and oxygen plus hypochlorite. The oxidative bleaching may be produced by a bleach selected from the group consisting of hydrogen peroxide, peracetic acid, ozone, chlorine dioxide and hypochlorite.

In another aspect, the invention relates to a kraft pulp delignification mixture comprising:

(a) 0.01 to 32 parts by weight of a peracid or a mixture of two peracids having pKa's of about 6.0 to 10.0, preferably peracetic acid or a mixture of peracetic and peroxymonosulfuric acids;
(b) 1000 parts by weight of water at a pH from 2.5 to 1 unit lower than the lower pKa of the two peracids, preferably pH 3.0 to 7.2;
(c) from 10 to 666 parts by weight of a kraft pulp, preferably 87 to 538 parts by weight; and
(d) from 0.01 part to 27 parts by weight of ozone, the ratio of ozone to kraft pulp being in the range from 0,001 to 0.05, preferably from 0.005 to 0.03.

DETAILED DESCRIPTION OF THE INVENTION

The combination of ozone and caroate provides a superior delignification to that provided by either alone. The addition of ozone to caroate increases oxidizing power of caroate without increasing effluent, and the addition of caroate to ozone decreases the degradation of cellulose without decreasing the degradation of lignin. The application of two oxidants simultaneously or sequentially, without washing after the first addition, is not a common practice in kraft pulp bleaching. The simultaneous (D/C) or sequential (D→C) addition of chlorine dioxide and chlorine is the only commonly used two-oxidant system in kraft pulp bleaching. In principle, if two chemicals are added simultaneously, they may react with each other resulting in a loss of oxidizing power. This was a major concern with ozone/caroate because ozone is a strong electrophile while caroate is a weak nucleophile. Moreover, if the oxidants are added sequentially the second chemical might be wasted by further oxidizing lignin sufficiently oxidized by the first oxidant. Thus, it was surprising to discover that, in fact, the combination of ozone and caroate provides a superior delignification system, leading to a higher ratio of viscosity to kappa number.

The amount of residual lignin in a pulp is measured by its kappa number; 0.15 times the kappa number is the weight percent of lignin. Softwood pulp coming out of a kraft process has a kappa number of 20 to 30; hardwood pulp is somewhat lower: 10 to 20. It is desirable for most uses to reduce the kappa number as much as possible, but in any event to below about 10 for softwood and about 5 for hardwood. At the same time, the production of paper having a desirable degree of strength requires that the cellulose be minimally degraded. The integrity of cellulosic structures is measured by determining the viscosity of a cupriethylenediamine solution according to the procedures described in TAPPI standard method T230. Softwood pulp coming out of a kraft process has a viscosity, in this test, of about 22 to 40 centipoises (cp). It is desirable to maintain the viscosity above 15 during delignification. The measure of a selective delignification process is thus a high ratio of viscosity to kappa number.

In hindsight the superior selectivity of caroate plus ozone may be rationalized by hypothesizing that the caroate anion acts as a trap for the less discriminate hydroxyl radical (.OH) that arises from the ozone, while still providing an effective medium for the oxidation of lignin.

Figure 1:
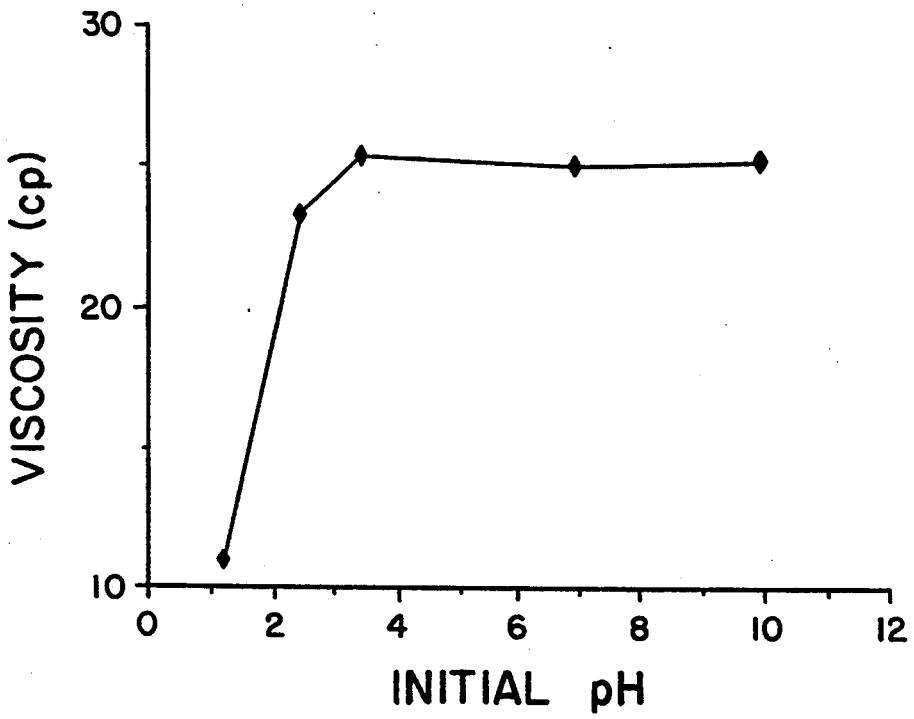
FIG. 1 is a graph of viscosity versus pH for caroate delignification reactions.

Studies on caroate delignification showed that viscosity loss was minimal if the oxidation was conducted at pH 2.5 or above. This trend was observed for no less than five kraft pulps. A typical plot of pulp viscosity after treatment versus initial pH of treatment is shown in FIG. 1 for a southern pine kraft pulp. This pulp had an initial kappa number and viscosity of 27.0 and 27.3 cp respectively. A working hypothesis is that, unlike $H_2O_2$, caroate at pH $>2.5$ does not generate a significant concentration of hydroxyl radicals. In support of this hypothesis, the hydroxylation of N,N'-bisglutaryl-1,3-diamino-5-nitrobenzene, which appears to be a function of .OH concentration, is pronounced in $H_2O_2$ media in the presence of iron (an .OH generating system) and undetectable in caroate media.

Moreover, caroate might actually scavenge .OH by the reactions shown below (Edwards & Marsh, *Prog. Reaction Kinetics* 15: 35, 1989):

$$.OH + HSO_5^- \rightarrow H_2O + SO_5^{\bar{\cdot}} \quad [4.]$$

$$2SO_5^{\bar{\cdot}} \rightleftharpoons S_2O_{10}^{2-} \quad [5.]$$

$$S_2O_{10}^{2-} \rightarrow O_2 + 2SO_4^{\bar{\cdot}} \quad [6.]$$

The $SO_5^{\bar{\cdot}}$ radical is relatively unreactive, and correspondingly more selective between lignin and cellulose, while the sulfate radical anion ($2SO_4^{\bar{\cdot}}$) is reactive, but much less so than .OH. The highly desirable and unexpected result of this putative .OH scavenging by caroate is that when ozone and caroate are used together the resulting pulp has a higher viscosity at equivalent lignin content (kappa number) than when ozone alone is used. Because the hydroxyl radical is trapped by the proton on the caroate anion, other peracids are expected to function similarly as long as there is a reasonable concentration of the undissociated peracid; i.e. the medium is at least 1 pH unit lower than the pKa of the acid. Peracetic acid is of particular interest because it is known that peracetic acid is relatively inert towards cellulose above pH 4. Examples of other peracids that may be used in the process of the invention include, perpropionic acid, peroxybenzoic acid, and diperoxycarboxylic acids, particularly $C_2$ to $C_{16}$ acids such as 1,6-diperoxyhexanedioic acid, 1,8-diperoxyoctanedioic acid, 1,10-diperoxydecanedioic acid and 1,12-diperoxydodecanedioic acid. Peracids in general include inorganic and organic species containing at least one OOH moiety having a pKa less than 10. Mixtures of peracids may also be used, particularly mixtures of peroxymonosulfuric and peracetic acids.

The following examples support the invention.

EXAMPLE 1

Figure 2:
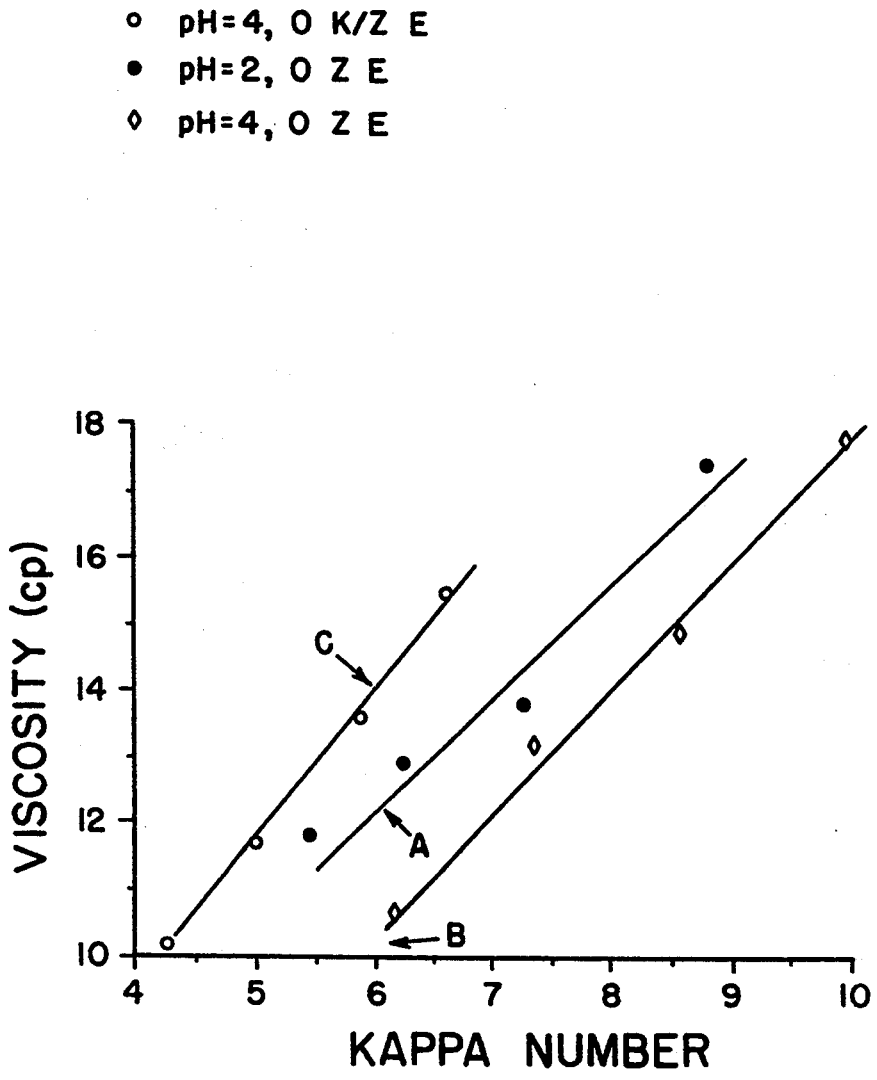
FIG. 2 is a graph of viscosity versus kappa number for an ozone delignification at pH 2 and at pH 4 and an ozone/caroate delignification at pH 4.

When ozone alone is used, a better ratio of viscosity to kappa number is obtained when the pulp is acid washed. This is shown in FIG. 2. The decomposition of ozone with the accompanying production of hydroxyl radicals is greatly accelerated by the presence of hydroxyl ions; as the pH rises this decomposition rises correspondingly. Ozone delignification is normally carried out at low pH. In addition, the presence of transition metals in unwashed pulp may exacerbate the problem. Transition metals, particularly iron at low pH and chromium and copper at higher pH, catalyze the formation of .OH.

Figure 3:
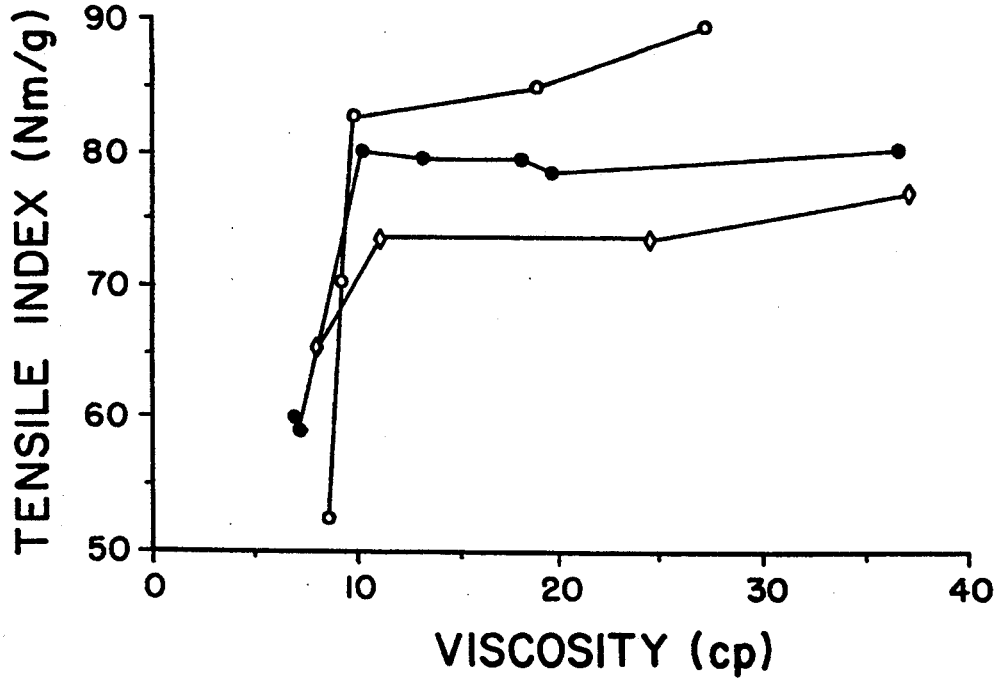
FIG. 3 is a graph of tensile index versus viscosity for three southern pine kraft pulps.

The results shown in FIG. 2 illustrate that transition metals and high pH have an adverse effect on ozone delignification. However, these effects can be remedied by the addition of caroate. The results were obtained with a softwood kraft pulp manufactured by modified continuous cooking. After oxygen delignification the pulp had a kappa number of 14.8 and viscosity of 27.4 cp. When the pulp was soaked in a pH 2 solution prior to dewatering (to 30% consistency) and ozonation, delignification was fairly selective with a viscosity of about 12 cp for a pulp with kappa no. 6 (see point A in FIG. 2). When ozonation was conducted at pH 4, without an acid-treatment, the viscosity for kappa no. 6 was about 10 (see point B in FIG. 2). The poorer selectivity due to transition metals and/or higher pH is consistent with the published literature. The inclusion of caroate (0.47% active $O_2$ on pulp) at pH 4 (no acid-treatment) resulted in a pulp with viscosity of about 14 cp at kappa number 6 (see point C in FIG. 2). The improvement in viscosity from 10 to 14 cp is extremely significant as shown in FIG. 3, which shows the non-linear relationship between viscosity and tensile strength for three southern pine pulps bleached with oxygen, caroate, hydrogen peroxide and chlorine dioxide but not ozone. Two were prepared by conventional kraft pulping-and had kappa numbers of 27.0 and 27.6 with respective viscosities of 27.3 and 37.3. The third pulp was obtained by modified, continuous kraft cooking; the kappa number was 23.9 and the viscosity 36.8. Below a critical viscosity of about 10 cp, tensile strength decreases quite dramatically. The critical viscosity for ozone delignified pulp is a bit lower: 9 cp.

EXAMPLE 2

Figure 4:
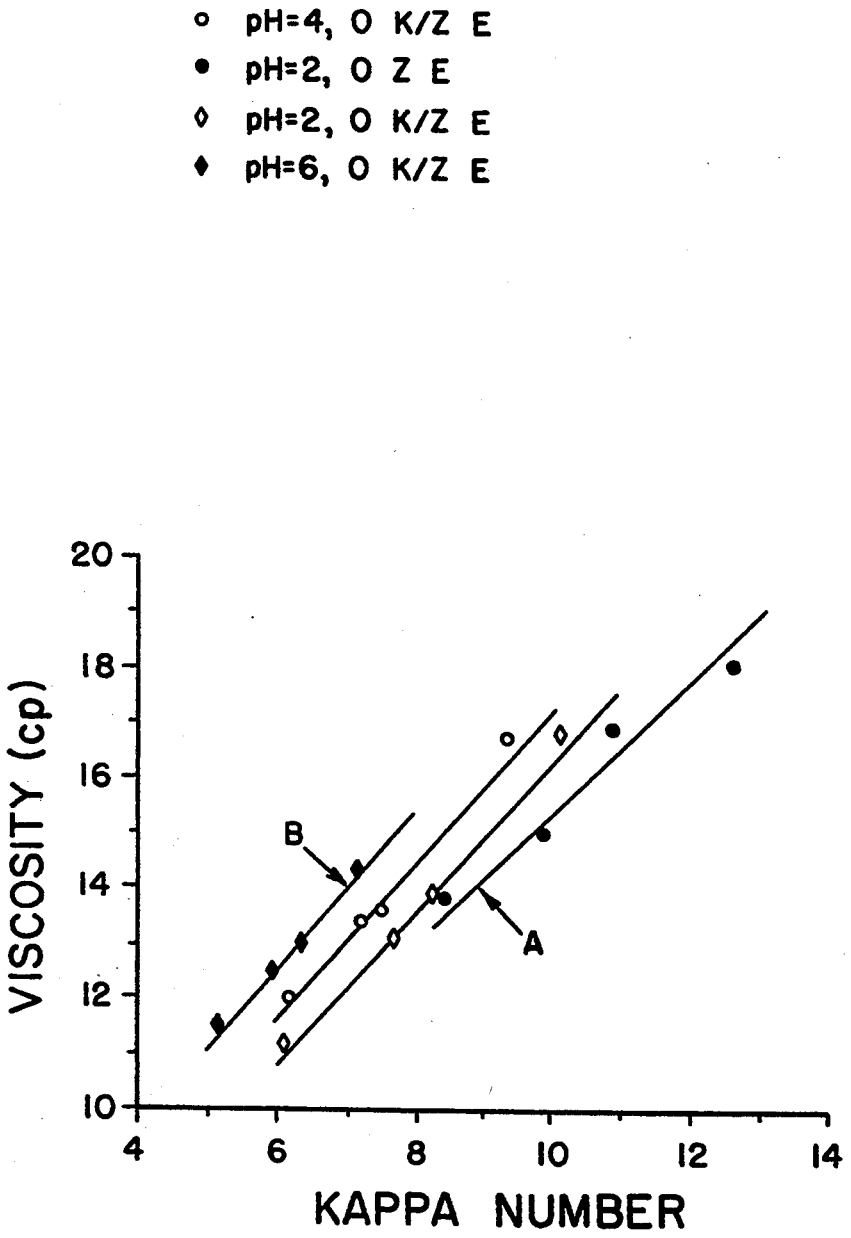
FIG. 4 is a graph of viscosity versus kappa number showing the effect of pH on ozone/caroate delignifications.

The effect of pH on ozone/caroate delignification was examined. When ozone and caroate were used together, a superior result was obtained, but only when the pH was greater than about 2.5. FIG. 4 shows the improvement in the ratio of viscosity to kappa number as the pH is raised from 2 to 4 to 6 for ozone/caroate delignification as compared to pH 2 (the optimal pH) for ozone alone. The results shown are for a conventional southern pine kraft pulp, acid washed at room temperature and pH 2. At a viscosity of 14 cp, the kappa number could be reduced from 9.0 for ozone alone (point A in FIG. 4) to 6.9 for ozone plus caroate (point B in FIG. 4) at pH 6.

EXAMPLE 3

The effect of the amount of caroate, i.e. the active oxygen charge provided by caroate was also examined.

Ideally caroate would be applied to pulp at 30% consistency, but due to limitations of laboratory-scale reactors, it had to be applied at 10% consistency and then the pulp had to be dewatered to 30%. To accommodate for this deviation in procedure, caroate consumption (the amount left on the pulp after dewatering) was used as the measure of active oxygen needed rather than using the total initially applied.

An oxygen-delignified softwood kraft pulp with kappa number 20.2 and viscosity 29.4 cp was acid-washed at room temperature with a HCl solution of pH 2.0. A fraction of the pulp was dewatered to 30% consistency, fluffed and ozonated at its optimum pH (2.10). Three other fractions of the pulp were treated with initial caroate charges of 0.24, 0.47, and 0.94% active oxygen on pulp at pH 4.0 and 10% consistency (one active oxygen atom per caroate molecule). The slurries were similarly dewatered to 30% consistency, fluffed and ozonated. Ideally going from 10% to 30% consistency should remove 74% of the caroate solution. However, during mixing and prior to dewatering the pulp consumed 0.5, 0.11, and 0.20% active $O_2$ for the three application levels. The untreated and three caroate-treated samples were each broken down into smaller fractions and treated at 23° C. with ozone charges varying from 0.5 to 3.0% on pulp. For a given caroate charge, its consumption did not vary significantly with ozone consumption. Caroate consumptions during ozonation were approximately 0.02, 0.06, and 0.10. Therefore, the total caroate consumptions were 0.07, 0.17, and 0.30% active $O_2$ on pulp for applications of 0.24, 0.47, and 0.94% on pulp.

Figure 5:
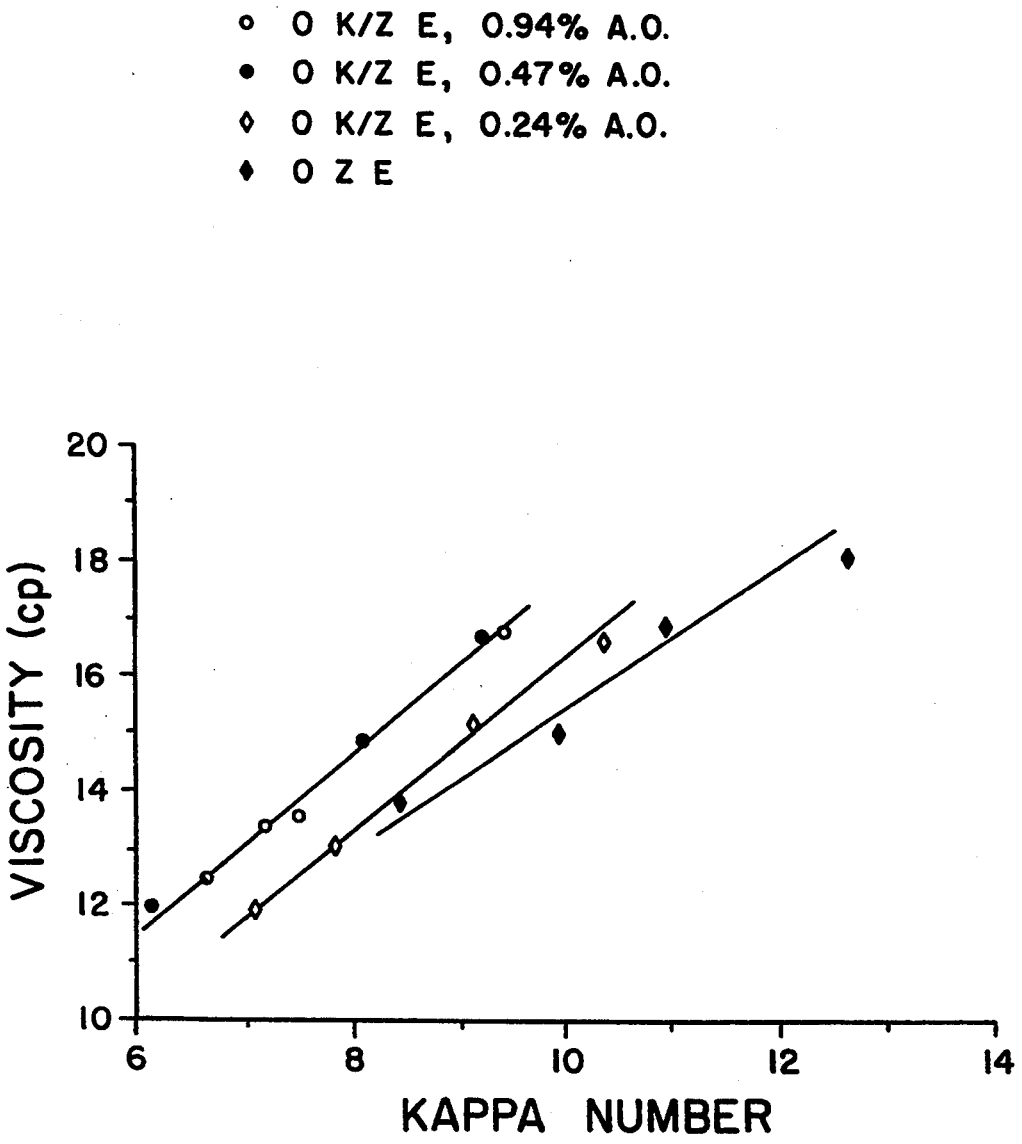
FIG. 5 is a graph of viscosity versus kappa number showing the effect of caroate charge on ozone/caroate delignifications.

The ozone (Z) and ozone/caroate (K/Z) delignified pulps were extracted with alkali then analyzed for kappa number and viscosity. Unless otherwise noted, the alkali extraction for all experiments was 2% NaOH on pulp at 80° C. and 12% consistency for 2 hours. The results are plotted in FIG. 5. It can be seen that at a given kappa number, the K/Z pulps had higher viscosities than the Z pulp. At a kappa number of 9.0, the Z pulp had an interpolated viscosity of 13.9 cp. The addition of caroate at 0.24% active oxygen on pulp led to the consumption of 0.07% active oxygen from caroate and if the kappa number were reduced to 9.0, the viscosity would have been (by interpolation) about 14.6. The addition of 0.47% or 0.94% active oxygen from caroate led to the consumption of 0.17% and 0.30% respectively, and the curves for viscosity vs kappa number were superimposed leading to a viscosity for both of 16.2 at kappa number 9.0. When caroate in the amount of 0.47% A.O. on pulp was applied without ozone and all of it was consumed, a kappa number of 14.8 was obtained.

EXAMPLE 4

Figure 6:
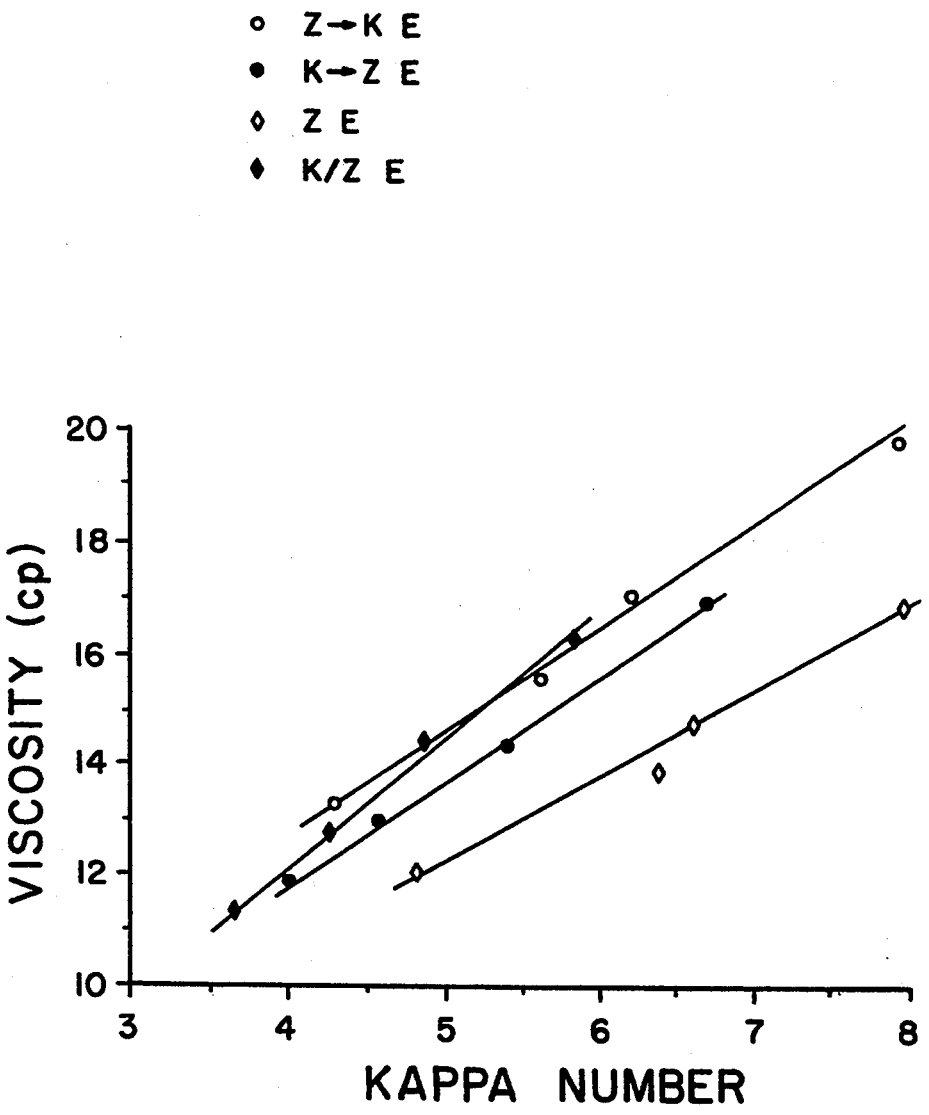
FIG. 6 is a graph of viscosity versus kappa number showing the effect of various modes of addition of caroate on ozone/caroate delignifications.

The mode of caroate addition was investigated with a commercial hardwood kraft pulp having kappa number 14.7 and viscosity 26.7 cp. Simultaneous addition of ozone and caroate was conducted at pH 4.0. The consumption of caroate during pulp preparation and ozonation was 0.17% A.O. on pulp. This mode of caroate application was compared to full consumption of 0.12% A.O. at 10% consistency, pH 4 and 40° C. followed by acidification, thickening and ozonation at pH 2.0 (K→Z) or the reverse process (Z→K). It can be seen (from FIG. 6) that all three addition modes resulted in improved selectivity.

The ratio of viscosity to kappa number, which measures the selectivity of the degradation of lignin over cellulose, is sensitive to pH (as seen in FIGS. 2 and 4) but is not apparently sensitive to temperature. By increasing time or temperature, one can drive the delignification to lower kappa numbers, but the viscosity will also fall, following the curves shown and the ratio will remain substantially constant. Thus, the temperature and duration of a delignification reaction will be determined by the kappa number that is desired to be obtained.

Similarly, the reaction can be carried out at various consistencies. In theory, the higher the consistency the smaller the sulfate waste stream; in practice, high consistencies (above 30%) lead to difficulties in ensuring homogeneity of the caroate on the pulp and the practical limits with present techniques are 1 to 40% with 8% to 35% preferred.

One skilled in the art will also recognize that in addition to the wood kraft pulp illustrated, one may apply the process of the invention to other known lignocellulosic materials preferably in comminuted form such as chips or to the pulps produced from such lignocellulosic materials to obtain analogous results.

The preferred lignocellulosic species are woody materials, especially tree woods including softwoods and hardwoods, but other lignocellulosic species commonly employed in making pulp and paper may be employed. Illustrative of these non-woody species are such materials as grasses, cereal straws, bamboo, cornstalks, sugar cane bagasse, kenaf, hemp, jute, sisal, esparto, reeds and the like.

The treatment according to the invention can follow a preliminary delignification step with oxygen ("O" step) or a simple preliminary step with one or more sequestering agents ("Q" step) in order to eliminate metallic impurities. A combination of both preliminary steps is also applicable.

The treatment according to the invention can be followed by any known bleaching step or steps such as an alkaline extraction ("E") step possibly enhanced by oxygen, hydrogen peroxide and/or hypochlorite ("Eo", "Ep", "Eh", "Eop", "Eoh") steps and one or several further oxidative bleaching steps with hydrogen peroxide ("P"), peracetic acid ("Paa"), ozone ("Z"), chlorine dioxide ("D") or hypochlorite ("H"). Examples of sequences of steps in which the process of the invention could be incorporated include the following:

(Q) K/Z Ep P and O (Q) K/Z Ep P wherein the parentheses indicate an optional Q step.

While the invention has been particularly shown and described with reference to preferred embodiments thereof, it will be understood by those skilled in the art that other changes in form and details may be made therein without departing from the spirit and scope of the invention.

We claim:

1. A process for delignifying a chemical pulp comprising reacting said pulp with a mixture of ozone and peroxymonosulfate, said mixture having a pH which is from about pH 1 to about 1 pH unit lower than the pKa of peroxymonosulfate.

2. A process according to claim 1 for delignifying a chemical pulp comprising treating said pulp at a temperature of 10° C. to 80° C. and pH 2.5 to 8.4 with the mixture of peroxymonosulfate and ozone.

3. A process according to claim 2 wherein said peroxymonosulfate is applied at from 0.1 to 2.0% active oxygen based on the dry weight of said chemical pulp.

4. A process according to claim 2 wherein said peroxymonosulfate is applied at from 0.1 to 0.5% active oxygen.

5. A process according to claim 2 wherein said pH is from 3.0 to 6.0.

6. A process according to claim 1 wherein said chemical pulp is a kraft pulp.

7. A process according to claim 1 wherein ozone is provided at from 0.1 to 5.0% based on the dry weight of said chemical pulp.

8. A process according to claim 7 wherein said ozone is provided at 0.5 to 3.0%.

9. A process according to claim 1 wherein said chemical pulp is at a consistency of from 1% to 40% in water.

10. A process according to claim 9 wherein said consistency is from 8 to 35%.

11. A process according to claim 1 wherein said temperature is 20° C. to 50° C.

12. A process according to claim 1 for delignifying a chemical pulp comprising treating said chemical pulp at a temperature of 10° to 80° C., said mixture having a pH from about 2.5 to about 1 pH unit lower than the pKa of said monoperacid.

13. A process according to claim 12 comprising the additional steps of:

(a) alkaline extraction; and (b) oxidative bleaching.

14. A process according to claim 13 wherein said alkaline extraction is enhanced by the addition of an oxidant selected from the group consisting of oxygen, hydrogen peroxide, hypochlorite, oxygen plus hydrogen peroxide and oxygen plus hypochlorite.

15. A process according to claim 13 wherein said oxidative bleaching is produced by a bleach selected from the group consisting of hydrogen peroxide, peracetic acid, ozone, chlorine dioxide and hypochlorite.

* * * * *

UNITED STATES PATENT AND TRADEMARK OFFICE

CERTIFICATE OF CORRECTION

PATENT NO. : 5,411,635

DATED : May 2, 1995

INVENTOR(S) : Francis et al.

It is certified that error appears in the above-indentified patent and that said Letters Patent is hereby corrected as shown below:

Column 10, line 7, delete "monoperacid" and substitute therefor --peroxymonosulfate--.

Signed and Sealed this

Twenty-first Day of November, 1995

*Attest:*

Bruce Lehman

BRUCE LEHMAN

*Attesting Officer*

*Commissioner of Patents and Trademarks*